US011246360B1

(12) United States Patent
Hanson Allen

(10) Patent No.: US 11,246,360 B1
(45) Date of Patent: Feb. 15, 2022

(54) ARM COMPRESSION GARMENT

(71) Applicant: Spanx, LLC, Atlanta, GA (US)

(72) Inventor: Wendy Hanson Allen, Atlanta, GA (US)

(73) Assignee: Spanx, LLC, Atlanta, GA (US)

( * ) Notice: Subject to any disclaimer, the term of this patent is extended or adjusted under 35 U.S.C. 154(b) by 539 days.

(21) Appl. No.: 14/743,689

(22) Filed: Jun. 18, 2015

Related U.S. Application Data

(60) Provisional application No. 62/014,020, filed on Jun. 18, 2014.

(51) Int. Cl.
*A41D 27/10* (2006.01)
*A41B 9/06* (2006.01)

(52) U.S. Cl.
CPC ..... *A41D 27/10* (2013.01); *A41B 9/06* (2013.01); *A41B 2400/38* (2013.01)

(58) Field of Classification Search
CPC ..... A41D 27/10; A41B 9/06; A41B 2400/38; A41C 1/12
See application file for complete search history.

(56) References Cited

U.S. PATENT DOCUMENTS

2007/0163026 A1* 7/2007 Perry ..... A41B 9/06 2/69
2010/0184355 A1* 7/2010 Kennedy ..... A41C 1/06 450/31
2011/0302686 A1* 12/2011 Chapuis ..... A41D 13/0015 2/69
2013/0298306 A1* 11/2013 Turner ..... A41D 1/08 2/115
2014/0273734 A1* 9/2014 Gordon ..... A41C 1/06 450/7
2014/0366585 A1* 12/2014 Shen ..... A41D 13/0015 66/175

(Continued)

OTHER PUBLICATIONS

Davis, Haydn. Warp knitted seamless hosiery from Karl Mayer. Knitting Trade Journal: Hosiery Knitting. Dec. 7, 2020. Retrieved from Aug. 21, 2012. https://www.knittingtradejournal.com/hosiery-knitting-news/11319-warp-knitted-seamless-hosiery-from-karl-mayer (Year: 2015).*

(Continued)

*Primary Examiner* — Anne M Kozak
(74) *Attorney, Agent, or Firm* — Meunier Carlin & Curfman LLC

(57) ABSTRACT

An arm compression garment according to various implementations includes a right arm section and a left arm section. Each arm section includes a first compressive area that is configured to extend around at least a portion of a humerus bone of a wearer's arm and a second compressive area adjacent the first area and extending distally therefrom. The first compressive area has a first compressive strength, and the second compressive area has a second compressive strength that is less than the first compressive strength. In certain implementations, each arm section is integrally formed on a hosiery machine with a bodice section. The bodice sections are then sewn together at the front and back edges thereof, such that there is a front seam configured to fit adjacent the wearer's sternum and a back seam configured to fit adjacent the wearer's spine.

31 Claims, 2 Drawing Sheets

(56) References Cited

U.S. PATENT DOCUMENTS

| | | | | |
|---|---|---|---|---|
| 2015/0038052 | A1* | 2/2015 | Hays | A41C 1/12 450/154 |
| 2015/0208734 | A1* | 7/2015 | Callahan | A41C 3/08 450/30 |
| 2016/0076175 | A1* | 3/2016 | Rock | D04B 1/246 66/171 |
| 2016/0249698 | A1* | 9/2016 | Berzowska | A41D 1/002 2/69 |
| 2017/0027240 | A1* | 2/2017 | McClean | A41C 1/003 |
| 2017/0224029 | A1* | 8/2017 | Turner | A41D 1/08 |

OTHER PUBLICATIONS

Amazing Arms, accessed Jan. 21, 2014, 1 page.
Annette Arm Sleeve Compression Garment, accessed Jan. 21, 2014, 1 page.
ARMore Secrecy Arm Shaper, accessed Jan. 21, 2014, 1 page.
Cass and Co. Lucky Back for Improving Posture, accessed Jan. 21, 2014, 1 page.
Flexees Ultimate Slimmer Arm Slimming Shrug, accessed Jan. 21, 2014, 1 page.
Inspiring Shaper Inspiring Upper Arm Shaper, accessed Jan. 21, 2014, 1 page.
Japanese Brand Ultra-Thin Wave Fat Burning Arm Shapwear, accessed Jan. 21, 2014, 1 page.
Marks and Spencer Flatter Me™ Light Control Cupless Armwear Crop Top, accessed Jan. 21, 2014, 1 page.
Mary Portas and Charnos Armory "Arm Hosiery" "Hide and Tone Flabby Underarms" UK Brand, accessed Jan. 21, 2014, 1 page.
Slim Me By MeMoi Basic Control Arm Shapers, accessed Jan. 21, 2014, 1 page.
Superwoman Bodyshaper Arm Shaper Sleeves (underarm tucking, bicep/tricep toning), accessed Jan. 21, 2014, 1 page.
Your Contour Arm Shaper, accessed Jan. 21, 2014, 1 page.
Your Contour Arm Shaper With Velcro-Long Sleeve, accessed Jan. 21, 2014, 1 page.
Your Contour Lace Bolero Arm Shapewear, accessed Jan. 21, 2014, 1 page.

* cited by examiner

ARM COMPRESSION GARMENT

RELATED APPLICATIONS

This application claims the benefit of U.S. Provisional Application No. 62/014,020, filed Jun. 18, 2014 and incorporated by reference in its entirety for all purposes.

BACKGROUND

Currently available arm compression garments include two arm portions that fit around at least a portion of the upper arms of a wearer. These garments may or may not include a bodice portion attached to the arm portions. In addition, most of these garments provide only one level of compression throughout the bodice and arms.

Many of the currently available arm compression garments are manufactured using a seamless machine, which requires the arm portions and the bodice portion to be cut separately and sewn together. This step may be time consuming and subject to more error.

Accordingly, there is a need in the art for an improved arm compression garment.

BRIEF SUMMARY

An arm compression garment according to various implementations includes a right arm section and a left arm section. Each arm section includes a first compressive area that is configured to extend around at least a portion of a humerus bone of a wearer's arm and a second compressive area adjacent the first compressive area and extending distally therefrom. The first compressive area has a first compressive strength, and the second compressive area has a second compressive strength that is less than the first compressive strength. In some implementations, the transition between the first and second compressive areas is not visually apparent. In addition, in certain implementations, each arm section is integrally formed on a hosiery machine with a bodice section. The bodice sections are then sewn together at the front and back edges thereof, such that there is a front seam configured to fit adjacent the wearer's sternum and a back seam configured to fit adjacent the wearer's spine.

In certain implementations, the first compressive area of the arm compression garment may be configured to extend distally from adjacent the wearer's shoulder joint and underarm and towards the wearer's elbow joint. The second compressive area may extend distally from adjacent the first compressive area and towards the wearer's wrist joint. In some implementations, the second compressive area extends to the portion of the wearer's arm above the elbow joint. In other implementations, the second compressive area extends around the elbow joint to a portion of the wearer's forearm. In addition, in some implementations, the first compressive area defines a motor movement portion configured to be disposed adjacent at least a portion of the wearer's tricep. The motor movement portion has a knit tightness that is greater than a knit tightness of a remaining portion of the first compressive area. The knit tightness of the motor movement portion may be between about 0.4 mm and about 0.5 mm greater than the knit tightness of the remaining portions of the first compressive area, according to some implementations.

In addition, each bodice section may include an underarm area configured to cover at least a portion of the wearer's underarm, according to certain implementations. The underarm area includes a motor movement portion that has a knit tightness that is greater than a knit tightness of the remaining portion of the underarm area. For example, the knit tightness of the motor movement portion may be between about 0.06 mm and about 0.08 mm greater than the knit tightness of the remaining portions of the underarm area.

Furthermore, the garment may include a right shoulder area that extends between the right bodice section and the first compressive area of the right arm section and a left shoulder area that extends between the left bodice section and the first compressive area of the left arm section, according to certain implementations. Each of the right and left shoulder areas may include a motor movement portion, and each motor movement portion has a knit tightness that is less than a knit tightness of a remaining portion of each shoulder area. For example, the knit tightness of the motor movement portions is between about 0.03 mm to about 0.05 mm less than the remaining portions of the shoulder areas.

In various implementations, the right and left bodice sections each include a front portion and a back portion, and the front portions of the right and left bodice sections are joined together and define a U-shaped edge portion configured for extending alongside and under the wearer's bust.

In other various implementations, an arm compression garment includes right and left arm sections and right and left bodice sections. Each of the right and left arm sections includes a compressive area configured to be disposed around at least a portion of a wearer's humerus. The compressive areas of the arm sections each have a compressive strength that is greater than a compressive strength of the bodice sections.

DETAILED DESCRIPTION

An arm compression garment according to various implementations includes a right arm section and a left arm section. Each arm section includes a first compressive area that is configured to extend around at least a portion of a humerus bone of a wearer's arm and a second compressive area adjacent the first area and extending distally therefrom. The first compressive area has a first compressive strength, and the second compressive area has a second compressive strength that is less than the first compressive strength. In some implementations, the transition between the first and second compressive areas is not visually apparent. In addition, in certain implementations, each arm section is integrally formed on a hosiery machine with a bodice section. The bodice sections are then sewn together at the front and back edges thereof, such that there is a front seam configured to fit adjacent the wearer's sternum and a back seam configured to fit adjacent the wearer's spine.

Figure 1:
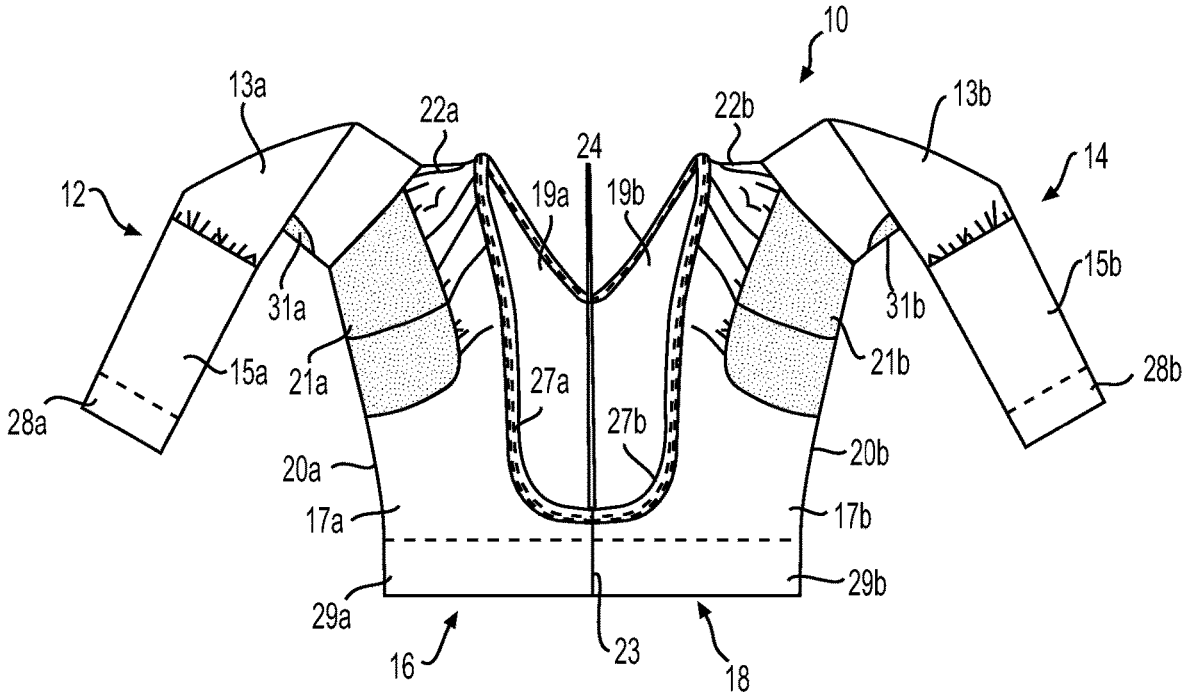
FIG. 1 illustrates a front view of an arm compression garment according to one implementation.

For example, in the implementation shown in FIG. 1, the arm compression garment 10 includes a right arm section 12, a left arm section 14, a right bodice section 16, and a left bodice section 18. Each of the arm sections 12, 14 includes a first compressive area 13*a*, 13*b* and a second compressive area 15*a*, 15*b*, respectively. The compressive areas 13*a*, 13*b*, 15*a*, 15*b* are configured to compress the wearer's arm in a radially inward direction (i.e., toward the wearer's arm bones). The first compressive areas 13*a*, 13*b* have a first compressive strength that is greater than a second compressive strength of the second compressive areas 15*a*, 15*b*, which is discussed more below. Each bodice section 16, 18 includes a front portion 17*a*, 17*b*, back portion 19*a*, 19*b*, side portions 20*a*, 20*b*, and underarm areas 21*a*, 21*b*, respectively.

Each first compressive area 13*a*, 13*b* of each arm section 12, 14, respectively, extends distally from adjacent the wearer's shoulder joint and underarm and towards the wearer's elbow joint. As used herein, "distally" refers to a direction away from the wearer's torso. Since these first compressive areas 13*a*, 13*b* have a relatively high compressive strength compared to the rest of the garment, the first compressive areas are effective at compressing unwanted skin and fat that may accumulate on the wearer's upper arm. These compressive areas 13*a*, 13*b* may prevent or lessen the appearance of sagging triceps.

The second compressive areas 15*a*, 15*b* of the arm sections 12, 14, respectively, extend distally from adjacent the first compressive area and towards the wearer's wrist joint. In some implementations, the second compressive areas extend to the portion of the arm above the wearer's elbow joint. In other implementations, such as the one shown in FIG. 1, the second compressive areas extend around each respective elbow joint to a portion of the wearer's forearm. For example, in the implementation shown in FIG. 1, the second compressive areas 15*a*, 15*b* extend between a distal edge of the first compressive area 13*a*, 13*b*, respectively, over the wearer's elbow joint, and around a portion of the wearer's forearm. Lower edges of the second compressive areas 15*a*, 15*b* are finished with an arm cuff band 28*a*, 28*b*, respectively, to prevent the areas 15*a*, 15*b* from rolling up the wearer's arms. In some implementations, the arm cuff bands 28*a*, 28*b* may be finished with a decorative trim. The arm cuff bands 28*a* and 28*b* may be included on implementations other than the one depicted in FIG. 1.

By having two different levels of compression along the length of the wearer's arm, such that the highest level of compression is adjacent a portion of the humerus and a lower level of compression is adjacent the elbow joint or forearm, the garment 10 provides a more desirable slimming and shaping effect for the upper arms of the wearer and is more comfortable. In particular, the upper arms appear to have more definition, or muscle tone. Currently available arm compression garments are not able to provide this level of improved slimming and shaping effect.

The right arm section 12 and the right bodice section 16 are integrally formed together and the left arm section 14 and the left bodice section 18 are integrally formed together on a hosiery machine. For example, the hosiery machine may have a cylinder of about 4 inches in diameter around which the knitting is formed. An edge of the front portion 17*a* of the right bodice section 16 is joined to a corresponding edge of the front portion 17*b* of the left bodice section 18 via a front sewn seam 23. Similarly, an edge of the back portion 19*a* of the right bodice section 16 is joined to a corresponding edge of the back portion 19*b* of the left bodice section 18 via a back sewn seam 24.

An upper portion of the right arm section 12 and an upper portion of the right bodice section 16 define a right shoulder area 22*a*. Similarly, an upper portion of the left arm section 14 and an upper portion of the left bodice section 18 define a left shoulder area 22*b*. In certain implementations, these shoulder areas 22*a*, 22*b* have a compressive strength that is substantially the same as or slightly less than the bodice sections 16, 18, respectively, to which they are integrally formed. For example, in certain implementations, each shoulder area 22*a*, 22*b* comprises a motor movement portion that has a knit tightness that is less than a knit tightness of a remaining portion of each shoulder area 22*a*, 22*b*. In particular, the knit tightness in the motor movement portion of the each shoulder area 22*a*, 22*b* may be between about 0.03 mm and about 0.05 mm (e.g., about 0.0403 mm in one implementation) looser than the knit tightness of the remaining portion of each shoulder area 22*a*, 22*b*. This lessened knit tightness may make the garment 10 feel more comfortable on the wearer's shoulders and may allow the garment 10 to fit around the wearer's shoulders better.

The front portions 17*a*, 17*b* of the right 16 and left bodice sections 18, respectively, define a U-shaped edge portion. Edges 27*a*, 27*b* of this U-shaped edge portion are configured for extending alongside and under the wearer's breasts. In particular, edge 27*a*, which is shown as a finished band in FIG. 1, of the right bodice section 16 extends downwardly from a shoulder area 22*a* alongside a base of the wearer's right breast and then curves inwardly under the breast toward the wearer's sternum. Similarly, edge 27*b*, which is shown as a finished band, of the left bodice section 18 extends downwardly from the shoulder area 22*b* along a base of the wearer's left breast and then curves inwardly under the breast toward the wearer's sternum. In other implementations, the front portions 17*a*, 17*b* may define a rectangular or other suitably shaped cut out or may not include a cut out.

As noted above, the right arm section 12 and the right bodice portion 16 may be integrally formed on a 4 inch diameter hosiery machine, and the left arm section 14 and the left bodice portion 18 may be integrally formed on the hosiery machine. The yarns used may include a combination of spandex and nylon according to certain implementations. In other implementations, polyester, cotton, and/or other suitable yarns may be used, and the various portions of the garment may be formed on another type of knitting machine, such as a seamless machine or other suitable knitting machine.

According to one implementation, the right side of the garment 10 is produced by knitting the arm cuff band 28*a*, the second compressive area 15*a*, the first compressive area 13*a*, the shoulder 22*a*, underarm 21*a*, and side areas 20*a*, the front and back bodice portions 17*a* and 19*a*, and finishing at the band 29*a*. The left side of the garment 10 is produced knitting the arm cuff band 28*b*, the second compressive area 15*b*, the first compressive area 13*b*, the shoulder 22*b*, underarm 21*b*, and side areas 20*b*, the front and back bodice portions 17*b* and 19*b*, and finishing at the band 29*b*. The sides are then joined together along the edges thereof as described above. The hosiery machine may include four yarn feeds, and each portion of the garment includes the following types of spandex and nylon yarns: (1) the arm cuff bands 28*a*, 28*b* may include four feeds of 20 single covered (SC) 12/7 Eversheer yarn (i.e., 20 denier spandex filaments, 12 denier nylon filaments, and a count of 7 nylon filaments) with one feed of 40/13 tex nylon yarn for makeup loops; (2) the second compressive areas 15*a*, 15*b* may include four ends of 20 SC 12/7 Eversheer yarn; (3) the first compressive areas 13*a*, 13*b* may include two ends of 20SC 12/7 Eversheer yarn and two ends of 90SC 40/34 yarn; (4) the right and left bodice sections 16, 18 may include two ends of 90SC 40/34 yarn and two ends of 2/40/46 tex nylon; and (5)

the band 29*a*, 29*b* includes two ends of 90SC 40/34 yarn and two ends of 2/40/46 tex nylon. The different yarns provide the different compressive strengths in each area. In other implementations, other types of filaments, ranges of deniers, and number of filaments may be selected for various portions of the garment. And, yarn deniers and filament counts may change with different types of yarns, depending on the desired effect of each portion of the garment.

The ability of each portion of the garment 10 to stretch laterally (or away from the wearer's body) depends, at least in part, on the types of yarns used, and the amount of stretch may change depending on the size of the garment 10. For example, various portions of the garment 10 produced according to the implementation described above and shown in FIGS. 1 through 4 may stretch laterally according to the following exemplary amounts, depending on the size of the garment 10: (1) the arm cuff bands 28*a*, 28*b* may stretch between about 15.5 inches to about 19.5 inches; (2) the second compressive areas 15*a*,15*b* may stretch between about 17.5 inches to about 21.5 inches; (3) the first compressive areas 13*a*, 13*b* may stretch between about 17 inches to about 21 inches; (4) each bodice section 16, 18 may stretch between about 21 inches to about 24.5 inches; and (5) each bodice band 29*a*, 29*b* may stretch between about 16.5 inches to about 19.5 inches. These measurements are taken for the various portions of the garment 10 in the greige state, or right off of the machine and prior to assembly with other portions. Thus, the amount of stretch of the bodice sections 16, 18 after being joined together is greater than the amounts listed above for each section 16, 18. Similarly, the amount of stretch of the bodice bands 29*a*, 29*b* after being joined together is greater than the amounts listed above for each bodice band 29*a*, 29*b*. The amount of lateral stretch may be measured by stretching the particular portion of the garment two dimensionally in a direction that is perpendicularly oriented to the part of the wearer's body against which the portion is configured to lie when worn.

The compressive strengths of each portion of the garment 10 may be measured using the BS6612 test (British Standards Institution) for compression properties, or similar standards. The BS6612 compression test utilizes a stretching device, for example, a HATRA apparatus or a CMD-100 device, which simulates the pressure exerted on the garment while it is worn. The BS6612 test measures a range of pressures felt by the garment wearer, assuming that the garment is of the appropriate fit for the wearer (as specified by the garment's defined size categories: S, M, L, etc.).

The measurements are taken when the hosiery is in the greige state, or right off of the machine and prior to assembly with other portions. For measurement, the hosiery is placed onto the stretching device. While the hosiery is on the stretching device, the tension in the fabric is measured with a measuring device. The tension measured by the measuring device is then converted to a pressure value, indicating the compressive strength of the hosiery as felt by the wearer.

The degree to which the stretching device used as part of the BS6612 compression test stretches the hosiery may be determined by the degree to which the hosiery would be stretched by a wearer of a given defined size category. As an example, for a Medium sized garment, the hosiery may first be stretched to a degree that simulates the size of a wearer on the low end of the Medium size category. A pressure measurement is taken at this low end of the size category. Next, the hosiery may be stretched to a degree that simulates the size of a wearer on the high end of the Medium size category, and another pressure measurement is taken. This produces a range of compressive strengths that may be felt by wearers that fall into the Medium size category.

Various portions of the garment 10 produced according to the implementation described above and shown in FIGS. 1 through 4 may have different compressive strengths as measured by the BS6612 test. For example, in one implementation: (1) the arm cuff bands 28*a*, 28*b* may have a compressive strength of 9-15 mmHg; (2) the second compressive areas 15*a*,15*b* may have a compressive strength of 7-13 mmHg; (3) the first compressive areas 13*a*, 13*b* may have a compressive strength of 8-14 mmHg; (4) each bodice section 16, 18 may have a compressive strength of 3-9 mmHg; and (5) each bodice band 29*a*, 29*b* may have a compressive strength of 7-14 mmHg.

In another implementation: (1) the arm cuff bands 28*a*, 28*b* may have a compressive strength of 6-12 mmHg; (2) the second compressive areas 15*a*,15*b* may have a compressive strength of 2-8 mmHg; (3) the first compressive areas 13*a*, 13*b* may have a compressive strength of 5-11 mmHg; (4) each bodice section 16, 18 may have a compressive strength of 1-7 mmHg; and (5) each bodice band 29*a*, 29*b* may have a compressive strength of 3-9 mmHg.

The compressive strength of a given garment portion is at least partially influenced by the linear mass density of the spandex fibers used in the portion. Higher density fibers may result in higher compressive strengths. For example, for one implementation of garment 10: (1) each arm cuff band 28*a*, 28*b* may have a compressive strength of 11-13 mmHg and spandex fibers ranging from 78-156 dtex; (2) each second compressive area 15*a*, 15*b* may have a compressive strength of 8-10 mmHg and spandex fibers ranging from 44-78 dtex; (3) each first compressive area 13*a*, 13*b* may have a compressive strength of 11-13 mmHg and spandex fibers ranging from 78-156 dtex; (4) each bodice section 16, 18 may have a compressive strength of 5-7 mmHg and spandex fibers ranging from 22-44 dtex; and (5) each bodice band 29*a*, 29*b* may have a compressive strength of 8-10 mmHg and spandex fibers ranging from 44-78 dtex.

In another exemplary implementation of garment 10: (1) each arm cuff band 28*a*, 28*b* may have a compressive strength of 9-11 mmHg and spandex fibers ranging from 44-156 dtex; (2) each second compressive area 15*a*, 15*b* may have a compressive strength of 3-7 mmHg and spandex fibers less than or equal to 44 dtex; (3) each first compressive area 13*a*, 13*b* may have a compressive strength of 6-10 mmHg and spandex fibers ranging from 22-78 dtex; (4) each bodice section 16, 18 may have a compressive strength of 3-5 mmHg and spandex fibers less than or equal to 44 dtex; and (5) each bodice band 29*a*, 29*b* may have a compressive strength of 6-8 mmHg and spandex fibers ranging from 22-78 dtex.

The BS6612 test was performed for two example implementations of garment 10. The example implementations were stretched on a CMD-100 device prior to measurement. For the first compressive area 13*a*, measurements were taken at 31 centimeters from the distal end of the arm section 12. The circumference of the first compressive area 13*a* at the point of measurement was 27.33 centimeters. For the second compressive area 15*a*, measurements were taken at 10 centimeters from the distal end of the arm section 12. The circumference of the second compressive area 15*a* at the point of measurement was 20.44 centimeters. Given these testing setup parameters, for the first example implementation of garment 10 the compression value of the first compressive area 13*a* was 7.2 mmHg, and the compression value of the second compressive area 15*a* was 5.1 mmHg. Given the same testing setup parameters, for the second example implementation of garment 10 the compression value of the first compressive area 13*a* was 8.7 mmHg, and the compression value of the second compressive area 15*a* was 4.9 mmHg.

The underarm areas 21*a*, 21*b* are configured to cover at least a portion of the wearer's underarm, or arm pit. In some implementations, the underarm areas 21*a*, 21*b* may also cover a portion of the wearer's tricep and/or latissimus dorsi muscles. According to various implementations, most of the garment 10 is knit using a jersey stitch, but the underarm areas 21*a*, 21*b* are knit using a 3-feed tuck and hold stitch (also referred to as a "3 & 1 hold rib-tuck pattern"), which causes the fabric to "pucker" when it is not being worn. A motor movement portion of each underarm area 21*a*, 21*b* is knit more tightly than the remaining portion of the underarm area 21*a*, 21*b*. In particular, the motor movement portions of the underarm areas 21*a*, 21*b* may have a knit tightness that is between about 0.06 mm to about 0.08 mm greater than a knit tightness in remaining portions of the underarm areas 21*a*, 21*b*. In one implementation, the knit tightness of the motor movement portions of the underarm areas 21*a*, 21*b* is about 0.0714 mm greater than the knit tightness of the remaining portions of the underarm areas 21*a*, 21*b*. This type of stitch and the motor movement portions allow the garment 10 to lay flatter against the wearer's side. In addition, in some implementations, the transition between the motor movement portions and the remaining portions of the underarm areas 21*a*, 21*b* may not be visually apparent.

Figure 2:
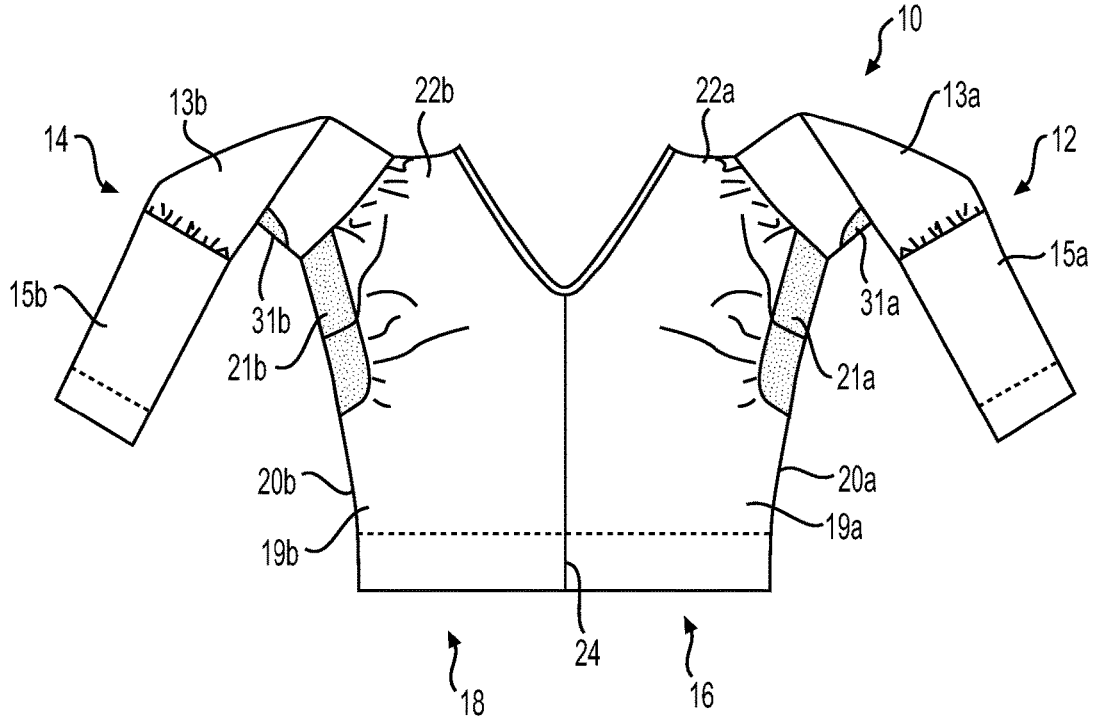
FIG. 2 illustrates a back view of the arm compression garment of FIG. 1.

In addition to the motor movement portions of the underarm areas 21*a*, 21*b*, each first compressive area 13*a*, 13*b* also defines a substantially oval shaped motor movement portion 31*a*, 31*b*, respectively, along a portion of the wearer's tricep, according to the implementation shown in FIGS. 1 and 2. The motor movement portions 31*a*, 31*b* of the first compressive areas 13*a*, 13*b* have a knit tightness that is between about 0.4 mm and about 0.5 mm (e.g., 0.458 mm in one implementation) greater than the remaining portions of the first compressive areas 13*a*, 13*b*. The motor movement portions 31*a*, 31*b* of the first compressive areas 13*a*, 13*b*, respectively, allow for more compression and control in the motor movement portions 31*a*, 31*b* for sagging arms. In addition, in some implementations, the transition between the motor movement portions and the remaining portions of the first compressive areas may not be visually apparent.

The non-motor movement portions of the first compressive areas 13*a*, 13*b* and the underarm areas 21*a*, 21*b* may have a level knit according to certain implementations. The knit tightness does not change significantly in these level knit portions.

Figure 3:
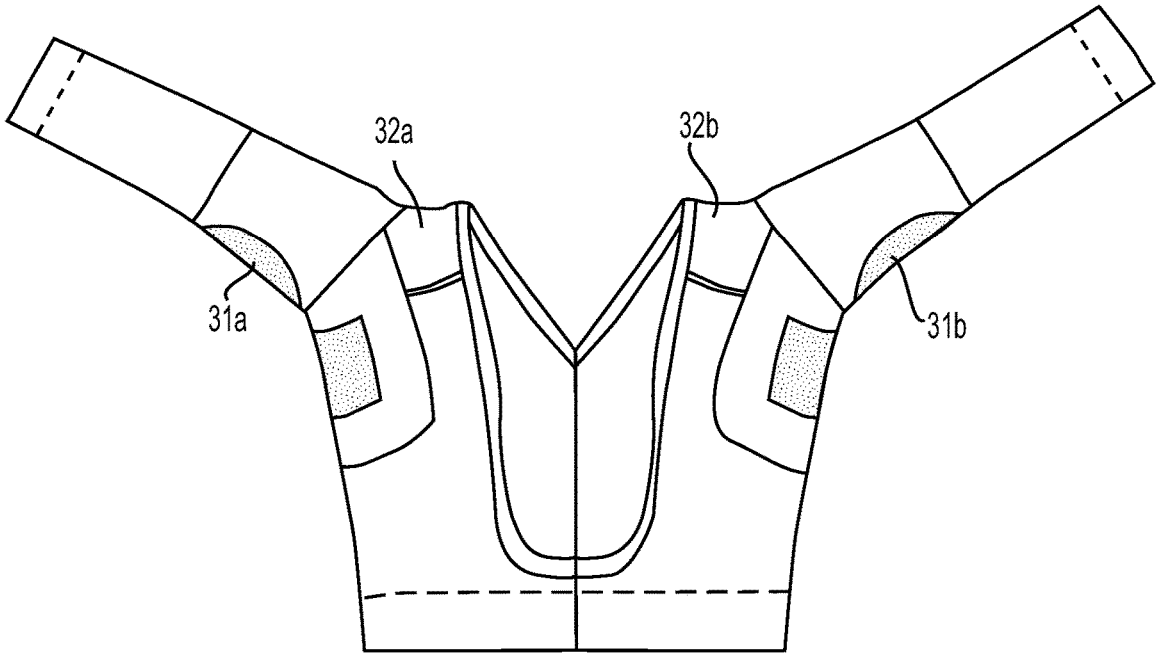
FIG. 3 illustrates a front view of an arm compression garment according to another implementation.

FIG. 3 illustrates an alternative implementation in which the shoulder areas 32*a*, 32*b* have a third compressive strength that is the greater than a compressive strength of the bodice sections 16, 18 and less than the first compressive strength of the first compressive areas 13*a*, 13*b*. This difference in compressive strength allows the garment to compress the area adjacent the shoulders to some degree but not as much as the garment 10 compresses the first compressive area 13*a*, 13*b* of the humerus below the shoulder, which allows the garment 10 to provide more desirable slimming and shaping to the upper arm. For example, this configuration provides the appearance that the shoulder area and upper arm areas have an appropriate amount of muscle tone and shape relative to each other. In certain implementations, the shoulder area is configured to extend from an upper edge of the first compressive area adjacent the shoulder joint to adjacent a portion of the wearer's scapula. In addition, in one implementation, the third compressive strength may be the same as the second compressive strength.

Figure 4:
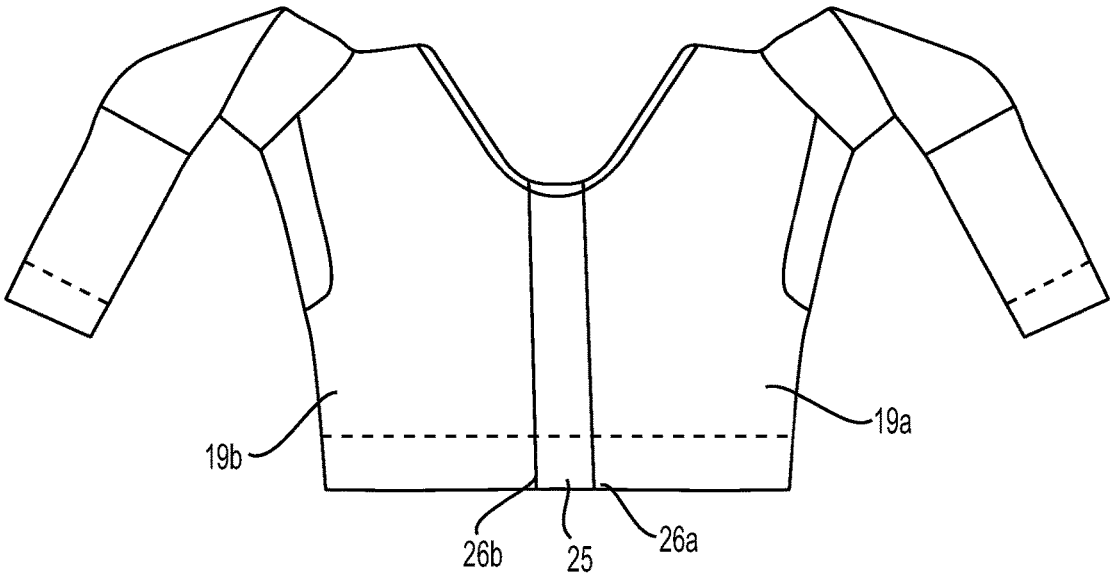
FIG. 4 illustrates a back view of an arm compression garment according to another implementation.

For arm compression garments made for larger sized wearers, the back portions 19*a*, 19*b* of the right 16 and left bodice sections 18 may be joined together via a panel 25, such as shown in FIG. 4. In particular, the panel 25 has a left edge that is sewn to the right edge of the back portion 19*b* of the left bodice section 18, and a right edge that is sewn to the left edge of the back portion 19*a* of the right bodice section 16. Thus, a seam 26*a* is formed between the right bodice section 16 and the panel 25, and a seam 26*b* is formed between the left bodice section 18 and the panel 25. A width of the panel 25 may vary depending on the size of the garment. For example, the width may be about 2 inches for XXL sized garments, and the width may be about 3 inches for XXXL sized garments, according to certain implementations. In certain implementations, these panels 25 may be jersey stitched on the hosiery machine, and the panels 25 may be free of any motor movement portions, according to certain implementations.

In alternative implementations, the arm sections may be separately formed from the bodice sections and sewn or otherwise attached thereto. Or, alternatively, the arm sections may be provided without the bodice sections. In such implementations, the arm sections may be provided with a hook and look type, snap fastener, or other means of securing an upper portion of the arm sections to the wearer's bra strap for ensuring that an upper portion of the arm sections does not move down the wearer's arm unintentionally. Alternatively, the arm sections may be configured to stay in place without a separate fastening means such as by relying on the compressive strength of the first compressive area.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The implementation was chosen and described in order to best explain the principles of the invention and the practical application, and to enable others of ordinary skill in the art to understand the invention for various implementations with various modifications as are suited to the particular use contemplated.

The invention claimed is:

1. An arm compression garment comprising right and left arm sections, right and left bodice sections, and a front and a back neckline each extending between right and left shoulder sections of the garment, the right and left arm sections each comprising a compressive area configured to be disposed around at least a portion of a wearer's humerus;

wherein each of the compressive areas of the arm sections has a compressive strength that is greater than a compressive strength of the bodice sections;

wherein the right and left bodice sections each comprise an arm pit area adjacent to the arm sections, each of the right and left arm pit areas comprising a varying level of knit tightness;

wherein the right and left bodice sections comprise a right and left side area, respectively, configured to cover at least a portion of the wearer's side below the arm pit, wherein the right and left side areas pucker when the garment is not in use, wherein each of the right and left side areas extend from right and left lateral sides of the garment beneath each of the right and left arm pit areas to contact at least a portion of each neckline, and wherein each of the right and left side areas have a level of knit tightness that is distinct from any level of knit tightness in the right or left arm pit areas;

wherein the front neckline comprises a cut out defining an edge portion curving inwardly to reach a lowest neckline portion that is configured to extend alongside and under the wearer's bust; and wherein the front neckline inferiorly extends at least twice as far as the back neckline.

2. The arm compression garment of claim 1, wherein the compressive area on each arm section is a first compressive area and the compressive strength of the first compressive area is a first compressive strength, each arm section further comprises a second compressive area having a second compressive strength, the first compressive strength is greater than the second compressive strength, and the second compressive area is configured to be disposed distally from the first compressive area.

3. The arm compression garment of claim 2, wherein the right and left bodice sections have a third compressive strength that is less than the first and second compressive strengths.

4. The arm compression garment of claim 3, wherein the right and left bodice sections each comprise a shoulder area configured to be disposed adjacent the wearer's shoulder joint and a portion of the wearer's scapula, the shoulder area having a fourth compressive strength that is less than the first compressive strength.

5. The arm compression garment of claim 2, wherein the first compressive strength is from 5-14 mmHg and the second compressive strength is from 2-13 mmHg.

6. The arm compression garment of claim 5, wherein the first compressive area comprises spandex fibers with a linear mass density from 22-156 dtex, and the second compressive area comprises spandex fibers with a linear mass density up to 78 dtex.

7. The arm compression garment of claim 5, wherein the first compressive strength is from 6-10 mmHg and the second compressive strength is from 3-7 mmHg.

8. The arm compression garment of claim 7, wherein the first compressive area comprises spandex fibers with a linear mass density from 22-78 dtex, and the second compressive area comprises spandex fibers with a linear mass density up to 44 dtex.

9. The arm compression garment of claim 1, wherein the right bodice section and the right arm section are integrally formed, and the left bodice section and the left arm section are integrally formed.

10. The arm compression garment of claim 9, wherein the right bodice section and the right arm section are integrally formed on a hosiery machine, the left bodice section and the left arm section are integrally formed on the hosiery machine, and the left and right bodice sections each comprise front edges that are directly joined together and back edges that are directly joined together.

11. The arm compression garment of claim 9, wherein the right bodice section and the right arm section are integrally formed on a hosiery machine, the left bodice section and the left arm section are integrally formed on the hosiery machine, the left and right bodice sections each comprise front edges that are directly joined together and back edges, and a separately formed panel having a first edge and a second edge is disposed between the back edges of the right and left bodice sections, the first edge being joined to the right back edge and the second edge being joined to the left back edge.

12. The arm compression garment of claim 9, wherein each of the right and left arm sections comprises a motor movement portion configured to be disposed adjacent at least a portion of the wearer's tricep, the motor movement portion having a knit tightness that is greater than a knit tightness of a remaining portion of each of the right and left arm sections.

13. The arm compression garment of claim 12, wherein the knit tightness of the motor movement portion is between 0.4 mm and 0.5 mm greater than the knit tightness of the remaining portion of each of the right and left arm sections.

14. The arm compression garment of claim 9, wherein a right shoulder area extends between the right bodice section and the right arm section and a left shoulder area extends between the left bodice section and the left arm section, each of the right and left shoulder areas comprises a varying level of knit tightness.

15. The arm compression garment of claim 14, wherein a knit tightness of a first portion of each of the left and right shoulder areas is between 0.03 mm to 0.05 mm less than a knit tightness of a second portion of each of the left and right shoulder areas.

16. The arm compression garment of claim 1, wherein a knit tightness of a first portion of each of the left and right arm pit areas is between 0.06 millimeters and 0.08 millimeters greater than a knit tightness of a second portion of each of the left and right arm pit areas.

17. The arm compression garment of claim 1, wherein each of the left and right arm pit areas has a different stitch pattern than each of the left and right bodice sections.

18. The arm compression garment of claim 1, wherein the right and left side areas are knit using a jersey stitch and the arm pit areas are knit using a 3-feed tuck and hold stitch.

19. An arm compression garment comprising a right arm section and a left arm section, each section comprising a first area that is configured to extend around at least a portion of a humerus bone of a wearer's arm and a second area adjacent the first area that is configured to extend around an elbow joint of the wearer's arm, the first area having a first compressive strength, and the second area having a second compressive strength, wherein the first compressive strength is greater than the second compressive strength; the garment further comprising a right arm pit area adjacent to the right arm section and configured to cover at least a portion of the wearer's right arm pit and left arm pit area adjacent to the left arm section and configured to cover at least a portion of the wearer's left arm pit, the right and left arm pit areas each comprising a varying level of knit tightness;

the garment further comprising a front and a back neckline each extending between right and left shoulder sections of the garment and a right and left side area configured to cover at least a portion of the wearer's side below the arm pit, wherein each of the right and left side areas extend from right and left lateral sides of the garment beneath each of the right and left arm pit areas to contact at least a portion of each neckline, wherein each of the left and right side areas have a level of knit tightness that is distinct from any level of knit tightness in the right or left arm pit areas, and wherein the right and left side areas pucker when the garment is not in use;

wherein the front neckline comprises a cut out defining an edge portion curving inwardly to reach a lowest neckline portion that is configured to extend alongside and under the wearer's bust; and wherein the front neckline inferiorly extends at least twice as far as the back neckline.

20. The arm compression garment of claim 19, wherein the first area is configured to extend from adjacent the wearer's shoulder joint and underarm to adjacent the wearer's elbow joint, and the second area is configured to extend from a lower edge of the first area adjacent the elbow joint to a portion of the wearer's forearm.

21. The arm compression garment of claim 19, further comprising a right bodice section and a left bodice section, wherein the right bodice section is directly adjacent the right arm section and the left bodice section is directly adjacent the left arm section, and wherein the right bodice section and the right arm section are integrally formed, and the left bodice section and the left arm section are integrally formed.

22. The arm compression garment of claim 21, wherein the right and left bodice sections each comprise a shoulder area configured to be disposed adjacent the wearer's shoulder joint and a portion of the wearer's scapula, the shoulder area having another compressive strength that is less than the first compressive strength.

23. The arm compression garment of claim 22, wherein each of the right and left bodice sections has a back edge configured to be disposed adjacent a portion of a spine of the wearer, and the back edges of the right and left bodice sections are directly joined together.

24. The arm compression garment of claim 22, wherein each of the right and left bodice sections has a back edge configured to be disposed adjacent a portion of a spine of the wearer, and a separately formed panel having a first edge and a second edge is disposed between the back edges of the right and left bodice sections, the first edge being joined to the right back edge and the second edge being joined to the left back edge.

25. The arm compression garment of claim 22, wherein the first area of each of the right and left arm sections comprises a motor movement portion configured to be disposed adjacent at least a portion of the wearer's tricep, the motor movement portion having a knit tightness that is greater than a knit tightness of a remaining portion of the first area.

26. The arm compression garment of claim 25, wherein the knit tightness of the motor movement portion is between 0.4 mm and 0.5 mm greater than the knit tightness of the remaining portions of the first area.

27. The arm compression garment of claim 22, wherein a right shoulder area extends between the right bodice section and the first area of the right arm section and a left shoulder area extends between the left bodice section and the first area of the left arm section, and wherein each of the right and left shoulder areas comprises a varying level of knit tightness.

28. The arm compression garment of claim 27, wherein a knit tightness of a first portion of each of the left and right shoulder areas is between 0.03 mm to 0.05 mm less than a knit tightness of a second portion of each of the left and right shoulder areas.

29. The arm compression garment of claim 19, wherein a knit tightness of a first portion of each of the left and right arm pit areas is between 0.06 millimeters and 0.08 millimeters greater than a knit tightness of a second portion of each of the left and right arm pit areas.

30. The arm compression garment of claim 19, wherein each of the left and right arm pit areas has a different stitch pattern than each of the left and right bodice sections.

31. The arm compression garment of claim 19, wherein the right and left side areas are knit using a jersey stitch and the arm pit areas are knit using a 3-feed tuck and hold stitch.

* * * * *